US010180001B2

(12) United States Patent
Leitch

(10) Patent No.: US 10,180,001 B2
(45) Date of Patent: Jan. 15, 2019

(54) ROOFING SHINGLE SYSTEM AND SHINGLES FOR USE THEREIN

(71) Applicant: Building Materials Investment Corporation, Dallas, TX (US)

(72) Inventor: Olan Leitch, Bakersfield, CA (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 15/369,044

(22) Filed: Dec. 5, 2016

(65) Prior Publication Data

US 2017/0175393 A1 Jun. 22, 2017

Related U.S. Application Data

(60) Provisional application No. 62/268,088, filed on Dec. 16, 2015.

(51) Int. Cl.

| | |
|---|---|
| ***E04D 1/26*** | (2006.01) |
| ***E04D 1/28*** | (2006.01) |
| *E04D 1/00* | (2006.01) |

(52) U.S. Cl.

CPC ..... *E04D 1/26* (2013.01); *E04D 1/28* (2013.01); *E04D 2001/005* (2013.01)

(58) Field of Classification Search

CPC ..... E04D 1/26; E04D 1/28; E04D 2001/005

See application file for complete search history.

(56) References Cited

U.S. PATENT DOCUMENTS

| | | | | |
|---|---|---|---|---|
| 1,705,497 | A | 3/1929 | Overbury | |
| 1,894,614 | A | 1/1933 | Wettlaufer | |
| 3,921,358 | A | 11/1975 | Bettoli | |
| 4,869,942 | A | 9/1989 | Jennus et al. | |
| 5,052,162 | A | 10/1991 | Bush et al. | |
| 5,181,361 | A | 1/1993 | Hannah et al. | |
| 5,195,290 | A | 3/1993 | Hulett | |
| 5,209,802 | A | 5/1993 | Hannah et al. | |
| D366,124 | S | 1/1996 | Hannah et al. | |
| 5,939,169 | A | 8/1999 | Bondoc et al. | |
| 6,010,589 | A | 1/2000 | Stahl et al. | |
| 6,038,826 | A | 3/2000 | Stahl et al. | |
| 6,038,827 | A * | 3/2000 | Sieling | E04D 1/26 428/143 |
| 6,058,670 | A * | 5/2000 | Sieling | E04D 1/26 52/554 |
| 6,105,329 | A * | 8/2000 | Bondoc | E04D 1/26 428/143 |
| 6,174,403 | B1 | 1/2001 | Steiner, Jr. et al. | |
| 6,220,329 | B1 | 4/2001 | King et al. | |
| 6,361,851 | B1 * | 3/2002 | Sieling | B32B 3/02 428/141 |

(Continued)

*Primary Examiner* — Adriana Figueroa

(74) *Attorney, Agent, or Firm* — Venable LLP

(57) ABSTRACT

A laminated roofing shingle is disclosed comprising a posterior layer with tabs spaced apart by openings and an anterior layer with tabs spaced apart by openings, wherein the anterior layer is positioned offset from the posterior layer such that it partially overlaps the posterior layer in a manner such that the anterior layer does not entirely overlap the surface of the posterior tabs. A roofing system comprising a plurality of courses of the shingles is also disclosed as well as a method of manufacturing the shingle.

60 Claims, 8 Drawing Sheets

(56) References Cited

U.S. PATENT DOCUMENTS

| | | | | |
|---|---|---|---|---|
| 6,421,976 | B1 * | 7/2002 | Elliott | E04D 1/26 52/555 |
| 6,510,664 | B2 | 1/2003 | Kupczyk | |
| 6,578,336 | B2 | 6/2003 | Elliott | |
| 6,679,020 | B2 | 1/2004 | Becker et al. | |
| 6,698,151 | B2 | 3/2004 | Elliott | |
| 6,804,919 | B2 * | 10/2004 | Railkar | E04D 1/26 52/105 |
| 6,933,037 | B2 * | 8/2005 | McCumber | B32B 3/00 428/143 |
| 7,082,724 | B2 | 8/2006 | Railkar et al. | |
| 7,240,462 | B2 | 7/2007 | Elliott et al. | |
| 8,522,510 | B2 | 9/2013 | Elliott et al. | |
| 8,968,507 | B2 | 3/2015 | Elliot et al. | |
| 9,464,439 | B2 * | 10/2016 | Buzza | E04D 1/12 |
| 9,739,062 | B2 * | 8/2017 | Leitch | E04D 1/28 |
| 2002/0178679 | A1 | 12/2002 | Whitmore | |
| 2004/0055241 | A1 * | 3/2004 | Railkar | E04D 1/26 52/555 |
| 2004/0123537 | A1 | 7/2004 | Elliott et al. | |
| 2005/0193673 | A1 * | 9/2005 | Rodrigues | B32B 3/06 52/518 |
| 2006/0179767 | A1 * | 8/2006 | Miller | B32B 3/08 52/555 |
| 2007/0017330 | A1 * | 1/2007 | Freshwater | B26D 3/10 83/13 |

* cited by examiner

ROOFING SHINGLE SYSTEM AND SHINGLES FOR USE THEREIN

FIELD OF THE INVENTION

This invention relates to an improved roofing shingle that gives the appearance of an increased number of roofing courses. The improved shingle appears thicker and more intricate and is therefore more visually appealing while also using less roofing material per unit area and requiring less installation time than traditional shingles. The invention also relates to a roofing system that utilizes the shingles and as well as a method of making the shingles that minimizes waste of roofing material. A reduction in roofing material also translates into reduced weight and thus reduced shipping costs.

BACKGROUND OF THE INVENTION

Roofing products are often divided into three broad groups: shingles, roll roofing, and underlayment. Shingles and roll roofing typically function as outer roof coverings designed to withstand exposure to weather and the elements. Shingles and roll roofing generally contain the same basic components which provide protection and long term wear associated with asphalt roofing products. These components include a base material made from an organic felt or fiberglass mat which serves as a matrix to support the other components and gives the product the required strength to withstand manufacturing, handling, installation and service in the intended environment. An asphalt coating formulated for the particular service application is often applied to the base material to provide the desired long-term ability to resist weathering and to provide stability under temperature extremes. An outer layer of mineral granules is also commonly applied to the asphalt coating to form a surface exposed to the weather which shields the asphalt coating from the sun's rays, adds color to the final product and provides fire resistance.

Asphalt shingles are among the most commonly used roofing materials. Such shingles are typically manufactured as single layer strip shingles, laminated shingles having two or more layers, interlocking shingles and large individual shingles in a variety of weights and colors. Such laminated asphalt shingles are also often referred to as composite shingles or as architectural shingles or dimensional shingles. Even though asphalt shingles offer significant cost, service life and flammability advantages over slate or wood shingles, slate or wood shingles are still often preferred due to the pleasing aesthetic appearance of a slate or wood shingled roof. An important aesthetic advantage of such slate or wood shingles is their greater thickness as compared to composite shingles. The thickness of slate or wood shingles results in a more pleasing, layered look for the finished roof.

Various composite shingles have been developed that have tabs in one or more layers. Examples of such composite shingles are shown in U.S. Pat. No. 1,894,614 entitled Strip Shingle, U.S. Pat. No. 3,921,358 entitled Composite Shingle; U.S. Pat. No. 4,869,942 entitled Trilaminated Roofing Shingle; U.S. Pat. No. 5,195,290 entitled Laminar Roofing Product; U.S. Pat. Appl. Publ. No. 2002/0178679 entitled Shingle for Optically Simulating a Tiled Roof; U.S. Pat. No. 6,679,020 entitled Multi-Layered Shingle and Method of Making Same; U.S. Pat. Appl. Publ. No. 2004/0123537 entitled Shingle with a Rendered Shadow Design; U.S. Pat. No. 6,038,827 entitled Trilaminate Roofing Shingle; U.S. Pat. No. 6,804,919 entitled Backer for Tabbed Composite Shingles; and U.S. Pat. No. 7,082,724 entitled Packaging of Tabbed Composite Shingles have a Backer Strip Containing Uniform, Identically Spaced, Vertical Projections on its Top Edge.

U.S. Pat. No. 3,921,358 discloses a two-layer composite roofing shingle. The upper layer has a headlap and a buttlap from which tabs are cut out. The tabs may be of varying breadths. The lower layer is an elongated strip that does not have tabs and is positioned below the buttlap and partially overlapping the headlap. The two layers may be of varying colors. The arrangement is intended to provide a shingle of variable thickness that simulates a wood shingle.

U.S. Pat. No. 4,869,942 discloses a three layer shingle. The upper layer has a tabbed edge. The middle layer (or shim sheet) has identical tabs to the upper layer and the two layers are disposed to overlap. The third layer is placed below the second layer and is a continuous strip without tabs. The cut outs are therefore two layers deep. The arrangement is intended to provide improved aesthetic appearance.

U.S. Pat. Appl. Publ. No. 2002/0178679 discloses a laminated shingle in which the upper layer includes a headlap and a buttlap from which tabs are cut out. The lower layer has no tabs and is placed below the buttlap and partly below the headlap of the upper layer. The edge of the lower layer may have a curving contour to match the shape of the lower edge of the tabs in the upper layer. When arranged in courses in a roofing system the lower layer and the overlaying tabs are arranged above the headlap of the vertically adjacent shingle in the lower course and are offset such that the headlap tabs of the shingle in the upper course align with the tabs of the headlap of the shingle in the lower course. The arrangement is intended to simulate a tiled roof.

U.S. Pat. No. 6,679,020 discloses tabbed laminated shingles composed of at least three layers. The layers of each laminated shingle are arranged such that the tabs of each layer are directly on top of one another. The tabs may be of unequal breadths. The tabs constitute the buttlap of the laminated shingle and when arranged in a roofing system these tabs overlap the headlap portion of the shingle in the lower course. The overlapping arrangement is intended to simulate a wooden shake roof.

U. S. Pat. Appl. Publ. No. 2004/0123537 discloses a laminated shingle in which the upper and lower layers are different. The upper layer includes a headlap and a buttlap from which tabs are cut out. The lower layer has no tabs and is placed below the buttlap and partly below the headlap of the upper layer. When arranged in courses in a roofing system the lower layer and the overlaying tabs are arranged above the headlap of the vertically adjacent shingle in the lower course. The tabs and lower layer have areas of darker coloration in order to simulate shadows. This is intended to provide a three-dimensional effect with greater apparent depth.

U.S. Pat. No. 6,038,827 discloses a trilaminated shingle in which all three layers are different. The anterior and middle layers have non-identical tabs whilst the posterior layer is an undivided strip that may have indentations. The anterior tabs are disposed over the middle tabs, but the tabs are not coextensive. All three layers are visible in the laminated shingle and the layers have different colors. This is intended to duplicate the effect of more expensive individual shake or slate shingles.

U.S. Pat. Nos. 6,804,919 and 7,082,724 disclose a composite shingle unit that includes a top and a bottom layer in which both layers have tabs. The layers are arranged such that the tabs of the lower layer point in the opposite direction to the tabs of the upper layer, providing lower layer tabs that are aligned with the gaps between tabs in the upper layer and the ends of the upper layer tabs are aligned with the straight edge of the lower layer. This is intended to create a shingle with an improved nailing zone for attachment to a roof.

Each of the above-referenced patents and patent applications is incorporated herein by reference in their entirety for all purposes within this application.

SUMMARY OF THE INVENTION

One embodiment of this invention pertains to a new laminated shingle having superior aesthetic appearance that simulates the appearance of more expensive shingles.

A preferred embodiment of the present invention is a two-layer laminated shingle, wherein the shingle has a posterior layer (also known as a lower layer or backer e.g., a backer sheet) and an anterior layer (also known an upper layer or facer), wherein both the anterior and the posterior layers each have a plurality of tabs spaced apart by a plurality of openings along one edge. The tabs of the anterior layer are affixed to the posterior layer but do not entirely cover the posterior layer and do not extend to the edges of the tabs in the posterior layer. Prior art two-layer laminated shingles that have tabs in both layers have superimposed the tabs of each layer directly on top of one another (see, e.g., U.S. Pat. No. 6,679,020) or have placed the tabs of the posterior layer below the headlap of the anterior layer. See, e.g., U.S. Pat. Nos. 1,894,614, 5,195,290, 6,804,919 and 7,082,724.

The aesthetically pleasing intricacy of the inventive shingles can be enhanced by using anterior tabs and posterior tabs of different colors.

In a preferred embodiment, the tabs of the anterior layer do not cover the tabs of the posterior layer and only extend to the edges of the openings in the posterior layer.

In a preferred embodiment, the tabs of the anterior layer are aligned with the openings in the posterior layer.

In another preferred embodiment, the posterior tabs and the posterior openings have no specific alignment with respect to the anterior tabs and the anterior openings.

In a preferred embodiment, the posterior layer is not as wide as the anterior layer. The laminated shingle thus has variable thickness, being composed of a single layer in some areas (for example, at least part of the tabs of the posterior layer) and being composed of a double layer in other areas (for example, where the tabs of the anterior layer are affixed to the posterior layer). This has the further advantage of reducing the amount of shingle material needed to cover a given unit area by eliminating areas of unnecessary material. If the posterior layer is less than half the width of the anterior layer, packing and storage of the laminated shingles is further facilitated when two shingles are packed together in a space efficient manner by facing the two posterior surfaces in opposite directions.

In a preferred embodiment, the shingles of the invention may simulate smaller exposure shingles and create the desirable visual effect of a thicker, more aesthetically pleasing shingle while not suffering from the disadvantages of smaller exposure shingles of increased manufacturing cost and increased installation time.

In a preferred embodiment, the shingles of the invention achieve the desirable appearance of small exposure shingles by employing identical teeth shape in the anterior and posterior layers.

In accordance with one embodiment of the present invention, a roofing system is provided having a multiplicity of courses of roofing shingles of the invention, wherein each shingle is a two-layer laminated shingle, wherein each shingle has a posterior layer and an anterior layer, wherein both the anterior and the posterior layers each have a plurality of tabs spaced apart by a plurality of openings along one edge. The tabs of the anterior layer are affixed to the posterior layer but do not entirely cover the posterior layer and do not extend to the edges of the tabs in the posterior layer. A shingle in a subsequently installed course is positioned on a shingle in previously installed course in a manner such that the posterior tabs of the shingle in the subsequently installed course are positioned over the anterior layer of the shingle in the previously installed course such that the posterior tabs of the shingle in the subsequently installed course do not entirely overlap the surface of the tabs of the anterior layer of the shingle in the previously installed course. When installed, the tabs create an intricate pattern that is aesthetically pleasing.

In a preferred embodiment, the layers create an appearance of a greater number of courses that may simulate more expensive smaller exposure shingles whilst minimizing the amount of roofing material needed.

In a preferred embodiment, the layers create the appearance that the tabs of the posterior layer are laminated.

In a preferred embodiment, the tabs in each shingle have a random horizontal offset relationship relative to the tabs in other shingles. This has the further advantage of simplifying installation by not requiring specific alignment of the shingles.

In one preferred embodiment, the tabs of the anterior layer in each shingle are aligned horizontally with tabs of the anterior layer of other shingles.

In a preferred embodiment, the tabs of the posterior layer are arranged such that posterior tabs of the shingles in a subsequently installed course cover the seams between shingles in a previously installed course. This has the further advantage of providing enhanced leak protection and reducing the amount of shingle material needed to cover a given area.

In accordance with one embodiment of the present invention, a method of manufacturing a laminated roofing shingle is provided, wherein each shingle is a two-layer laminated shingle, wherein the shingle has a posterior layer and an anterior layer, and wherein both the anterior and the posterior layers each have a plurality of tabs spaced apart by a plurality of openings along one edge. The tabs of the anterior layer are affixed to the posterior layer but do not entirely cover the posterior layer and do not extend to the edges of the tabs in the posterior layer. The layers are cut from sheets of roofing material; and posterior layer pieces and anterior layer pieces can be cut from a single sheet. The tabs are cut such that the posterior tabs for each posterior layer piece are complementary to the posterior tabs for another posterior layer piece and such that the anterior tabs for each anterior layer piece are complementary to the anterior tabs for another anterior layer piece that are cut from the same sheet. This results in a more efficient use of materials since less scrap pieces are generated during the manufacturing process compared to the manufacturing of some prior art shingles. A four wide machine line can be configured to cut posterior tabs in the two outer lanes and anterior tabs in the two inner lanes or to cut anterior tabs in the two outer lanes and posterior tabs in the two inner lanes.

In a preferred embodiment, the sequence of tabs and openings in each shingle piece results in each shingle piece having a tab at one end and an opening at the other end. This means that complementary shingle pieces have the same number of tabs and openings, allowing more efficient manufacturing of the inventive shingles.

In a preferred embodiment, Applicant's laminated roofing shingle comprises:

(a) a posterior layer having a posterior top portion having a posterior upper edge and a posterior lower edge, and a posterior bottom portion including a plurality of posterior tabs extending from said posterior top portion along said posterior lower edge, said posterior tabs spaced apart to define a plurality of posterior openings between said posterior tabs; and (b) an anterior layer having an anterior top portion having an anterior upper edge and an anterior lower edge, and an anterior bottom portion including a plurality of anterior tabs extending from said anterior top portion along said anterior lower edge, said anterior tabs spaced apart to define a plurality of anterior openings between said anterior tabs;

wherein the anterior layer is wider than the posterior layer, and wherein the anterior layer is positioned such that it partially overlaps the posterior layer such that the anterior tabs are positioned over the top portion of the posterior layer.

In a preferred embodiment, front edges of the anterior tabs are vertically aligned with said posterior lower edge. In another embodiment, the anterior layer partially overlaps the posterior tabs. In a further embodiment, the anterior tabs extend to front edges of said posterior tabs.

In a preferred embodiment, there is at least partial overlap between the top portion of the anterior layer and the top portion of the posterior layer.

In a preferred embodiment, the anterior layer and the posterior layer have the same length.

In a preferred embodiment, the number of posterior tabs and the number of anterior tabs is different. In a preferred embodiment, there are five posterior tabs and six anterior tabs. In another preferred embodiment, there are three posterior tabs and two anterior tabs.

In a preferred embodiment, the posterior tabs and the anterior tabs are horizontally offset. In another embodiment, the posterior tabs and the anterior tabs are horizontally aligned. In another embodiment, the anterior tabs and the posterior openings are horizontally aligned. In a further embodiment, the posterior tabs and posterior openings have no specific horizontal alignment with respect to the anterior tabs and anterior openings.

In one embodiment, at least one anterior tab has a first anterior tab breadth and at least another anterior tab has a second anterior tab breadth that differs from the first anterior tab breadth.

In one embodiment, at least one anterior tab has a first anterior tab height and at least another anterior tab has a second anterior tab height that differs from the first anterior tab height.

In another embodiment, at least one anterior opening has a first anterior opening breadth and at least another anterior opening has a second anterior opening breadth that differs from the first anterior opening breadth.

In one embodiment, at least one posterior tab has a first posterior tab breadth and at least another posterior tab has a second posterior tab breadth that differs from the first posterior tab breadth.

In one embodiment, at least one posterior tab has a first posterior tab height and at least another posterior tab has a second posterior tab height that differs from the first posterior tab height.

In a further embodiment, at least one posterior opening has a first posterior opening breadth and at least another posterior opening has a second posterior opening breadth that differs from the first posterior opening breadth.

In a preferred embodiment, both the posterior layer and the anterior layer have a tab at one end of the shingle and an opening at the other end of the shingle such that the end opening of the anterior layer is at the opposite end of the shingle to the end opening of the posterior layer.

In a preferred embodiment, the posterior tab breadths and the anterior tab breadths are the same. In another preferred embodiment, the posterior tab breadths and the anterior tab breadths are different.

In a preferred embodiment, the posterior tab heights and the anterior tab heights are the same. In another embodiment, the height of at least one posterior tab differs from the height of at least one anterior tab.

In another preferred embodiment, the posterior tab height is between about 40% and 50% of the posterior layer width. In a preferred embodiment, the anterior tab height is between about 15% and 30% of the anterior layer width. In a preferred embodiment, the posterior tab height is about 2.25 inches and the anterior tab height is about 2.25 inches.

In a preferred embodiment, each anterior tab, each anterior opening, each posterior tab and each posterior opening has right angle corners. In another preferred embodiment, each anterior tab, each anterior opening, each posterior tab and each posterior opening is a trapezoid.

In a preferred embodiment, the length of the shingle is about 39.375 inches. In a preferred embodiment, the width of the shingle is about 13.25 inches. In a preferred embodiment, the width of the posterior layer is between about 30% and 70% of the width of the anterior layer.

In a preferred embodiment, the width of the posterior layer is about 5.375 inches.

In a preferred embodiment, the width of the anterior layer is about 11 inches.

In a preferred embodiment, the posterior tabs and the anterior tabs are the same color. In another preferred embodiment, the posterior tabs and the anterior tabs are different colors. In a preferred embodiment, the anterior tabs are the same color as at least part of the anterior top portion. In a preferred embodiment, the posterior tabs are the same color as at least part of the posterior top portion.

In a preferred embodiment, the shingle is a two-layer laminated roofing shingle.

In a preferred embodiment, the length of the shingle is about 39.375 inches, the width of the shingle is about 13.25 inches, the posterior tab height is about 2.82 inches, the anterior tab height is about 2.82 inches, the width of the posterior layer is about 6.5 inches and the width of the anterior layer is about 10.44 inches.

In a preferred embodiment, a roofing system of the invention comprises at least two shingles in vertically adjacent courses, each of the shingles comprising:

(a) a posterior layer having a posterior top portion having a posterior upper edge and a posterior lower edge, and a posterior bottom portion including a plurality of posterior tabs extending from said posterior top portion along said posterior lower edge, said posterior tabs spaced apart to define a plurality of posterior openings between said posterior tabs; and (b) an anterior layer having an anterior top portion having an anterior upper edge and an anterior lower edge, and an anterior bottom portion including a plurality of anterior tabs extending from said anterior top portion along said anterior lower edge, said anterior tabs spaced apart to define a plurality of anterior openings between said anterior tabs;

wherein the anterior layer is wider than the posterior layer, wherein the anterior layer is positioned such that it partially overlaps the posterior layer such that the anterior tabs are positioned over the top portion of the posterior layer, and wherein the shingle in the upper course is positioned to partially overlap the shingle in the lower course such that the posterior tabs of the shingle in the upper course partially overlap the anterior top portion of the shingle in the lower course.

In a preferred embodiment, front edges of the posterior tabs of the shingle in the upper course are vertically aligned with said anterior lower edge of the shingle in the lower course. In another embodiment, the posterior tabs of the shingle in the upper course partially overlap the anterior tabs of the shingle in the lower course. In a further embodiment, the posterior tabs of the shingle in the upper course extend to the front edges of the anterior tabs of the shingle in the lower course.

In a preferred embodiment, shingles in vertically adjacent courses are horizontally offset. In a preferred embodiment, the tabs of each shingle have a random horizontal offset relationship relative to the tabs of shingles in other courses. In another preferred embodiment, the shingles are horizontally offset and the anterior tabs are horizontally aligned.

In another preferred embodiment, the shingles in each course are arranged such that if a first shingle has a posterior tab at an end, it horizontally abuts a second shingle such that said posterior tab abuts a posterior opening at an end of the second shingle.

In another preferred embodiment, the shingles in each course are arranged such that if a first shingle has an anterior tab at an end, it horizontally abuts a second shingle such that said anterior tab abuts an anterior opening at an end of the second shingle.

In a preferred embodiment, there are 9 tabs per square foot.

In a preferred embodiment, a plurality of courses of the shingles of the invention are installed on a roof deck in overlapping courses.

In a preferred embodiment, the seams between shingles in the lower course are covered by posterior tabs of shingles in the upper course.

In a preferred embodiment, the roofing system gives the visual appearance of a number of courses that is greater than the actual number of courses.

In a preferred embodiment, a method of manufacturing an inventive laminated roofing shingle is provided, the shingle comprising:

(a) a posterior layer having a posterior top portion having a posterior upper edge and a posterior lower edge, and a posterior bottom portion including a plurality of posterior tabs extending from said posterior top portion along said posterior lower edge, said posterior tabs spaced apart to define a plurality of posterior openings between said posterior tabs; and (b) an anterior layer having an anterior top portion having an anterior upper edge and an anterior lower edge, and an anterior bottom portion including a plurality of anterior tabs extending from said anterior top portion along said anterior lower edge, said anterior tabs spaced apart to define a plurality of anterior openings between said anterior tabs;

wherein the anterior layer is wider than the posterior layer, wherein the anterior layer is positioned such that it partially overlaps the posterior layer such that the anterior tabs are positioned over the top portion of the posterior layer, and wherein at least one anterior layer and at least one posterior layer are cut from a single sheet of roofing material.

In a preferred embodiment, the sheet has a width of about 56.5 inches. In another preferred embodiment, the sheet has a width of about 67.75 inches.

In a preferred embodiment, four posterior layers and four anterior layers are cut from a single sheet of roofing material.

In a preferred embodiment, the tabs and openings of at least two anterior layers are complementary. In a preferred embodiment, the tabs and openings of at least two posterior layers are complementary.

In a preferred embodiment, the anterior layers and the posterior layers each have an opening at one end of each layer and a tab at the other end of each layer.

In a preferred embodiment, the layers are cut on a machine line selected from the group consisting of a 2-wide machine line, a 4-wide machine line and a 6-wide machine line.

In a preferred embodiment, anterior layers are cut on at least one outer lane. In another preferred embodiment, posterior layers are cut on at least one outer lane.

In a preferred embodiment, the length of the shingle is about 39.375 inches, the width of the shingle is about 13.25 inches, the posterior tab height is about 2.25 inches, the anterior tab height is about 2.25 inches, the width of the posterior layer is about 5.375 inches and the width of the anterior layer is about 11 inches.

In another preferred embodiment, the length of the shingle is about 39.375 inches, the width of the shingle is about 13.25 inches, the posterior tab height is about 2.82 inches, the anterior tab height is about 2.82 inches, the width of the posterior layer is about 6.5 inches and the width of the anterior layer is about 10.44 inches.

DETAILED DESCRIPTION OF THE FIGURES

For a more complete understanding of the present invention, and the advantages thereof, reference is now made to the following descriptions taken in conjunction with the accompanying figures, but which are not to be construed as limiting the scope of the present invention as defined by the appended claims, in which:

Figure 1:
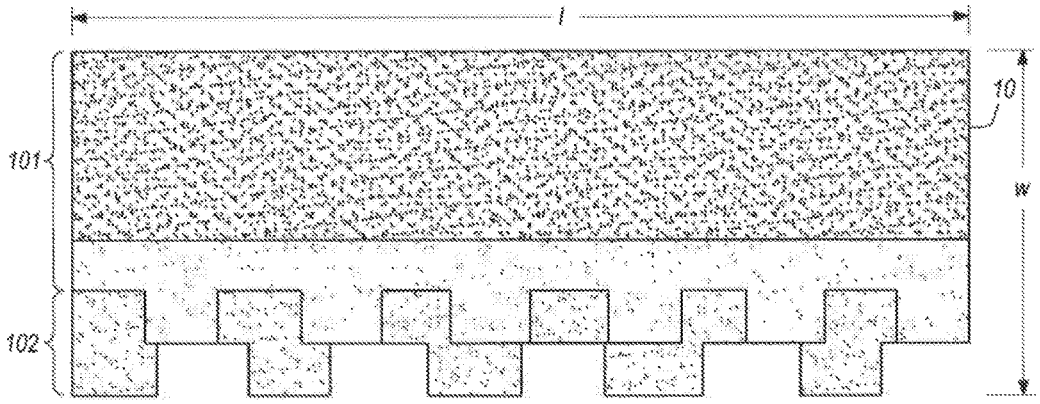
FIG. 1 shows a top plan view of an exemplary embodiment of a two-layer roofing shingle of the present invention.
Figure 1A:
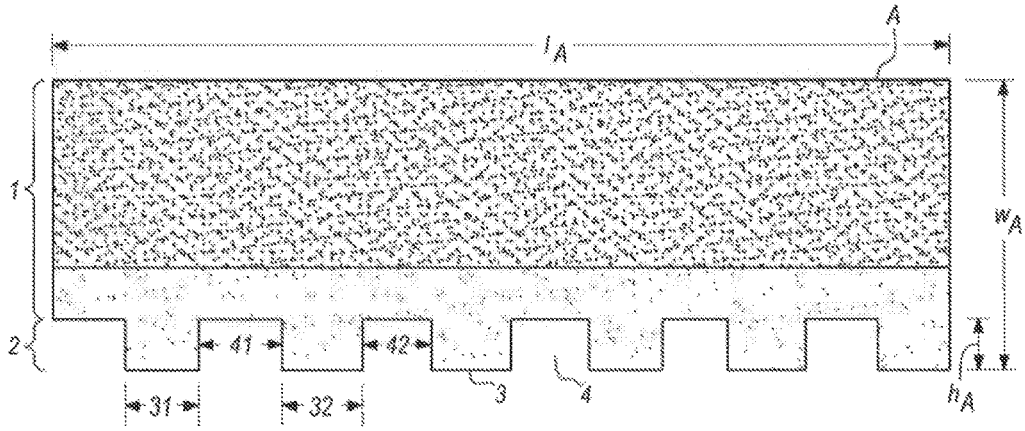
FIG. 1A shows a top plan view of the anterior layer of the shingle of FIG. 1.
Figure 1B:
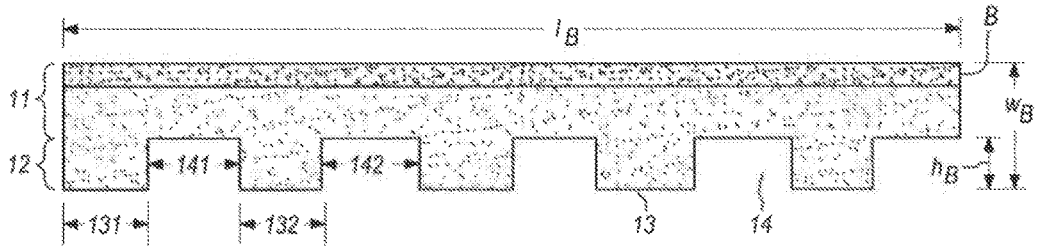
FIG. 1B shows a top plan view of the posterior layer of the shingle of FIG. 1.
Figure 9A:
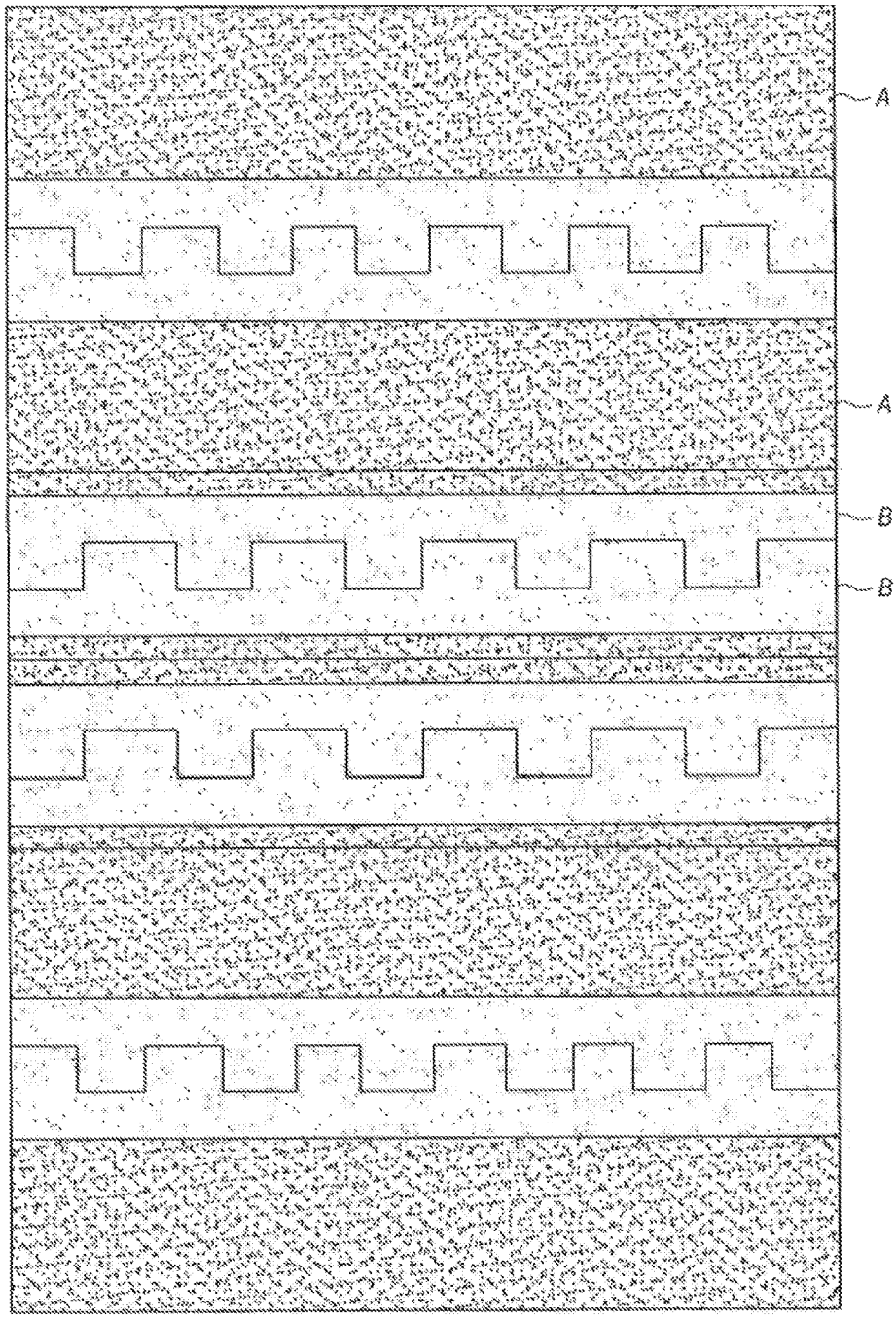

FIG. 9A shows a top plan schematic of a sheet of roofing material from which is cut on a four wide machine line four separate tabbed anterior layers corresponding to the anterior layers A of the shingles of FIG. 1A and four separate tabbed posterior layers corresponding to the posterior layers B of the shingles of FIG. 1B. The anterior layers A are cut on the two outer lanes and the posterior layers B are cut on the inner lanes.

Figure 9B:
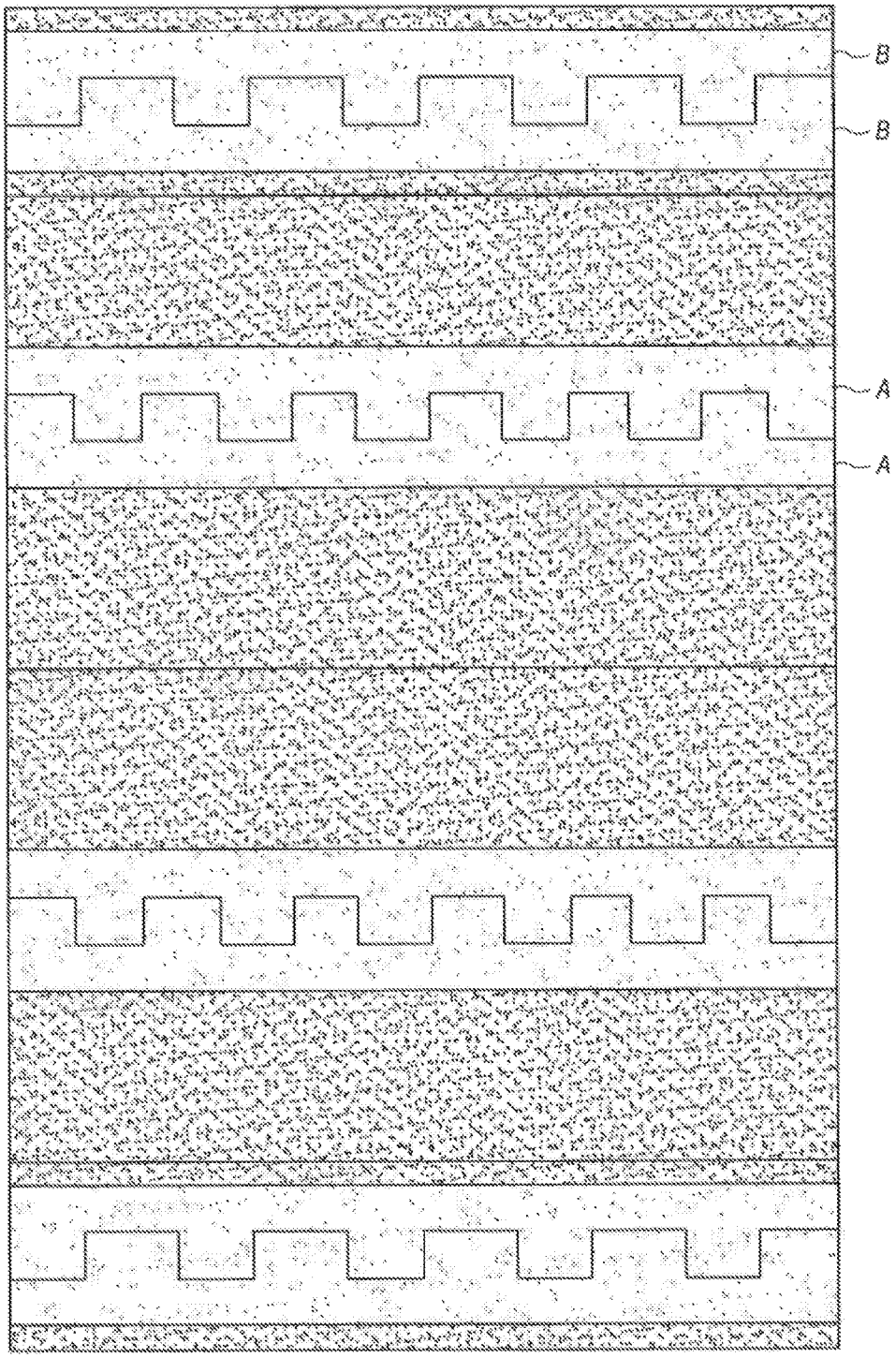

FIG. 9B shows a top plan schematic of a sheet of roofing material from which is cut on a four wide machine line four separate tabbed anterior layers corresponding to the anterior layers A of the shingles of FIG. 1A and four separate tabbed posterior layers corresponding to the posterior layers B of the shingles of FIG. 1B. The posterior layers B are cut on the two outer lanes and the anterior layers A are cut on the inner lanes.

Figure 2:
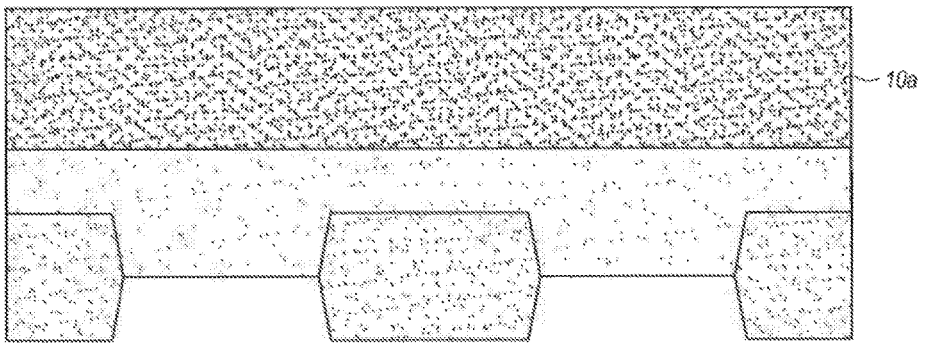
FIG. 2 shows a top plan view of another exemplary embodiment of a two-layer roofing shingle of the present invention.
Figure 2A:
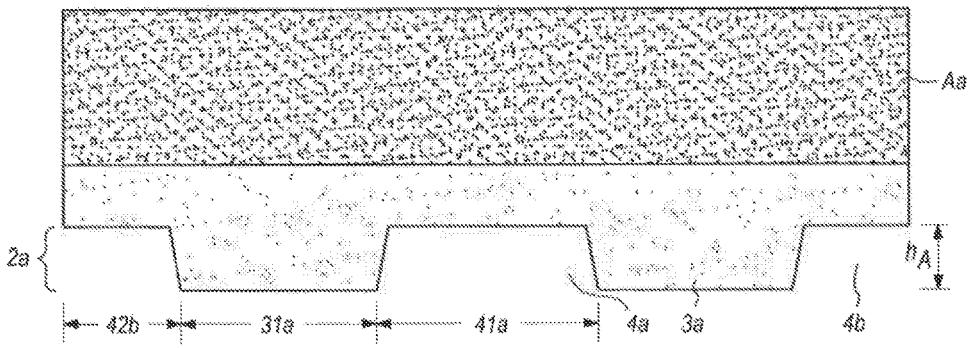
FIG. 2A shows a top plan view of the anterior layer of the shingle of FIG. 2.
Figure 2B:
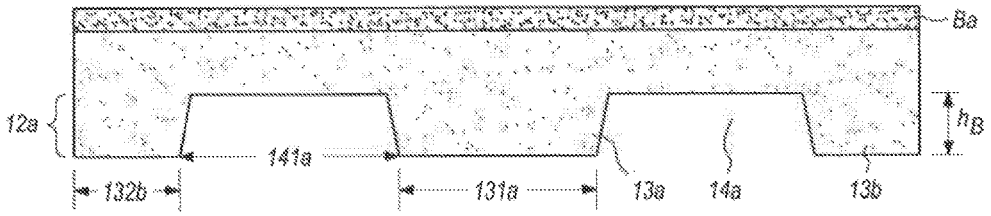
FIG. 2B shows a top plan view of the posterior layer of the shingle of FIG. 2.
Figure 10:
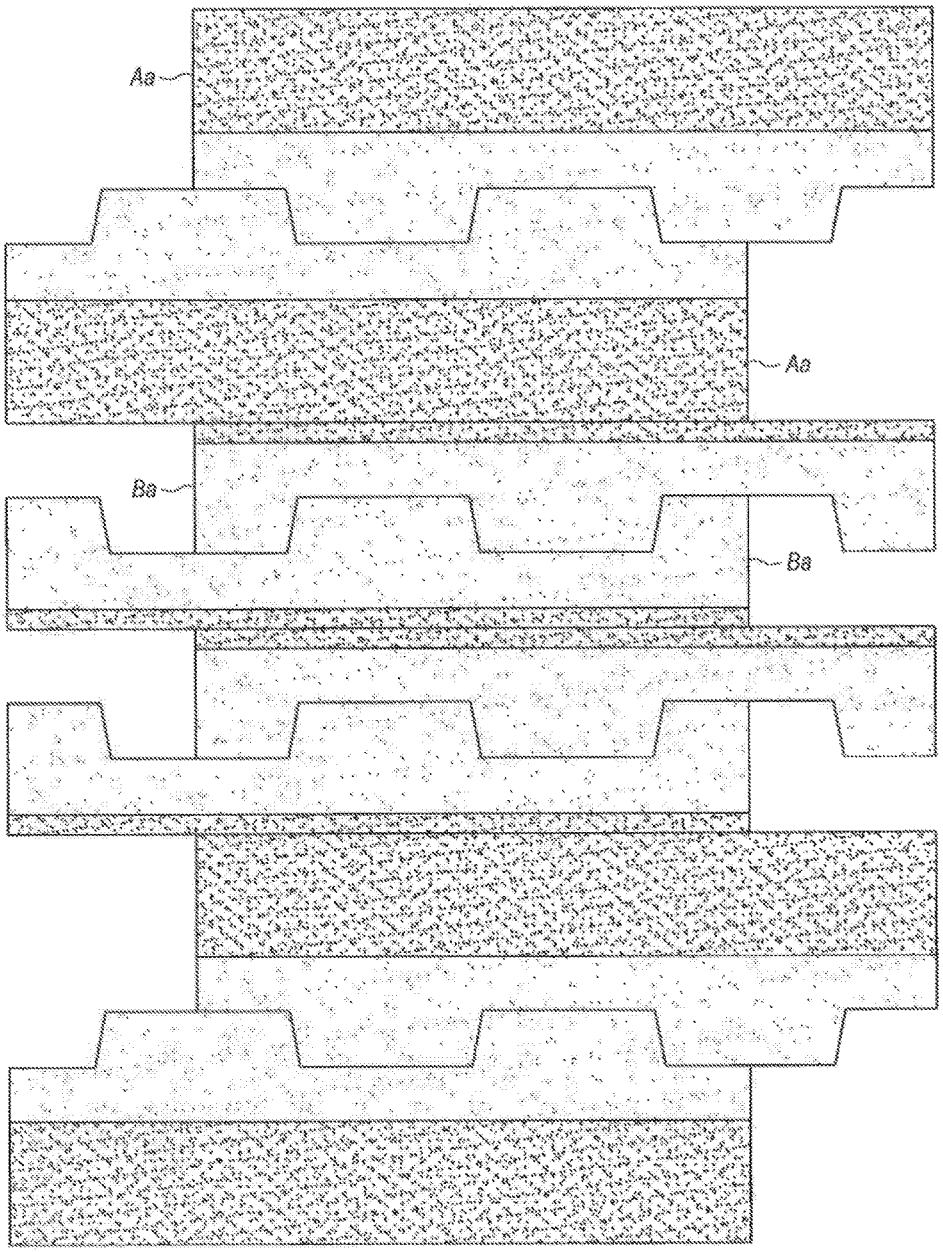

FIG. 10 shows a top plan schematic of a sheet of roofing material from which is cut on a four wide machine line four separate tabbed anterior layers corresponding to the anterior layers Aa of the shingles of FIG. 2A and four separate tabbed posterior layers corresponding to the posterior layers Ba of the shingles of FIG. 2B. The anterior layers Aa are cut on the two outer lanes and the posterior layers Ba are cut on the inner lanes.

DETAILED DESCRIPTION

The preferred embodiments of the present invention and its advantages are best understood by referring to FIGS. 1 through 10, like numerals being used for like and corresponding parts of the various drawings. The different shadings of the individual layers in the drawings are not intended to signify a particular color value or intensity but only to indicate color contrasts between the layers, and each individual layer may be lighter or darker than the shadings indicate.

The first embodiment of the present invention, which relates to two-layer composite roofing shingles having the appearance of variable thickness, will now be described in greater detail by referring to the drawings that accompany the present application.

Figure 7:
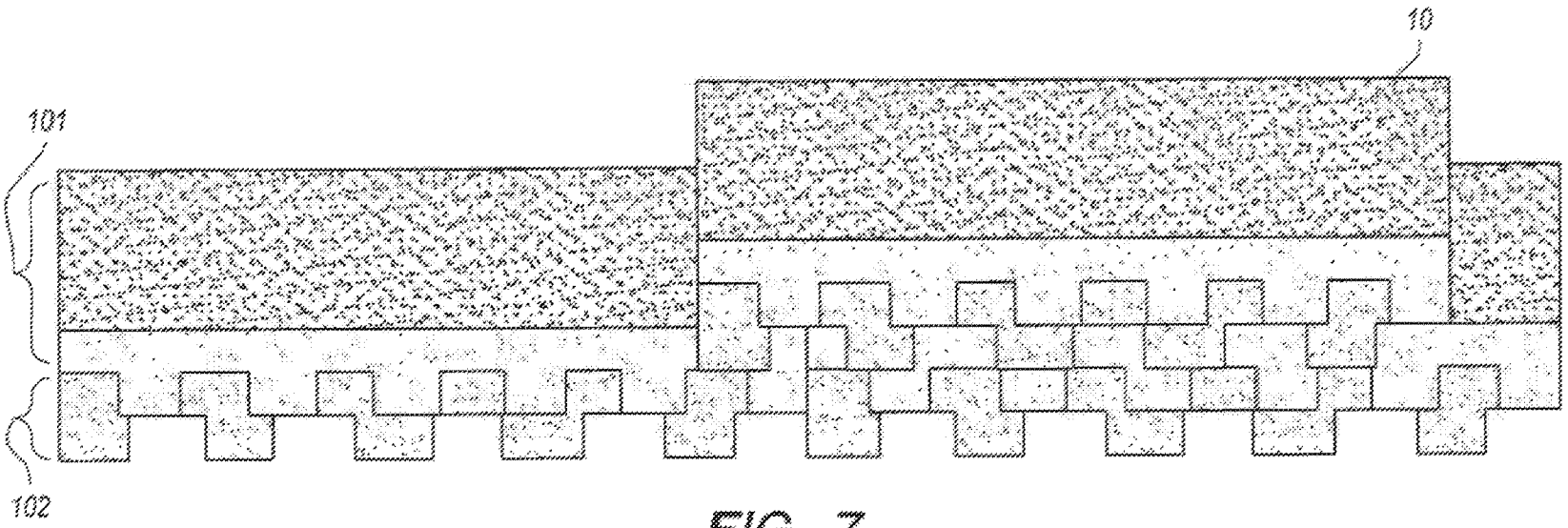
FIG. 7 shows a top plan view of an exemplary embodiment of a roofing system of the present invention incorporating various two-layer roofing shingle embodiments of the present invention depicted in FIG. 1.

A shingle 10 incorporating one embodiment of the present invention is shown in FIG. 1. FIG. 1 illustrates a top plan view of shingle 10. Shingle 10 has a width (w) and a length (l). Shingle 10 comprises an anterior layer A and posterior layer B. Shingle 10 further comprises a composite headlap 101 and a composite buttlap 102, wherein when installed on a roof deck, as illustrated in FIG. 7, at least a portion of the composite headlap 101 of a previously installed shingle 10 is covered by the composite buttlap 102 of a subsequently installed shingle 10.

Preferably the width (w) of the shingle is 13.25 inches and the length (l) of the shingle is 39.375 inches. In another preferred embodiment the width (w) of the shingle is 12 inches and the length (l) of the shingle is 36 inches.

FIGS. 1A and 1B separately illustrate a top plan view of anterior layer A and posterior layer B, respectively. Referring to FIG. 1A, anterior layer A has a width ($w_A$) and a length ($l_A$). Anterior layer A comprises a top portion 1 and a bottom portion 2. The bottom portion 2 comprises a plurality of anterior tabs 3 separated by anterior openings 4. The anterior tabs 3 have a breadth 31 and a height ($h_A$). Preferably, at least one anterior tab 3 has a first anterior tab breadth 31 and at least another anterior tab 3 has a second anterior tab breadth 32.

Preferably, the anterior tab height ($h_A$) may be between 15% and 30% of the anterior layer A width ($w_A$). In a particularly preferred embodiment the anterior tab height ($h_A$) is 20% of the anterior layer A width ($w_A$). In another particularly preferred embodiment the anterior tab height ($h_A$) is 26% of the anterior layer A width ($w_A$).

Preferably, the anterior layer A width ($w_A$) may be between 10 and 12 inches. In a particularly preferred embodiment the anterior layer A width ($w_A$) is 11 inches. In another particularly preferred embodiment the anterior layer A width ($w_A$) is 10.88 inches.

Preferably, the anterior tab height ($h_A$) may be between 1 and 3 inches. In a particularly preferred embodiment the anterior tab height ($h_A$) is 2.25 inches. In another particularly preferred embodiment the anterior tab height ($h_A$) is 2.82 inches. The anterior tab height ($h_A$) may be the same or different for each anterior tab 3. In one embodiment, at least one anterior tab 3 has a height (first height) that differs from the height (second height) of another anterior tab 3.

The anterior openings have breadths 41, 42. Preferably, at least one anterior opening 4 has a first anterior opening breadth 41 and at least another anterior opening 4 has a second anterior opening breadth 42. In a preferred embodiment, the horizontal sequence of anterior tab breadths 31 and anterior opening breadths 41 lacks a defined sequence.

Referring to FIG. 1B, posterior layer B has a width ($w_B$) and a length ($l_B$). Posterior layer B comprises a top portion 11 and a bottom portion 12. The bottom portion 12 comprises a plurality of posterior tabs 13 separated by posterior openings 14. The posterior tabs 13 have a breadth 131 and a height ($h_B$). Preferably, at least one posterior tab 13 has a first posterior tab breadth 131 and at least another posterior tab 13 has a second posterior tab breadth 132.

Preferably, the posterior layer B width ($w_B$) may be between 30% and 70% of the anterior layer A width ($w_A$). In a particularly preferred embodiment the posterior layer B width ($w_B$) is 49% of the anterior layer A width ($w_A$). In another particularly preferred embodiment the posterior layer B width ($w_B$) is 60% of the anterior layer A width ($w_A$).

Preferably, the posterior layer B width ($w_B$) may be between 5 and 7 inches. In a particularly preferred embodiment the posterior layer B width ($w_B$) is 5.375 inches. In another particularly preferred embodiment the posterior layer B width ($w_B$) is 6.5 inches.

In a particularly preferred embodiment, the anterior layer A length ($l_A$) and the posterior layer B length ($l_B$) are the same. Preferably, the anterior layer A length ($l_A$) is 39.375 inches and the posterior layer B length ($l_B$) is 39.375 inches.

Preferably, the posterior tab height ($h_B$) may be between 40% and 50% of the posterior layer B width ($w_B$). In a particularly preferred embodiment the posterior tab height ($h_B$) is 42% of the posterior layer B width ($w_B$). In another particularly preferred embodiment the posterior tab height ($h_B$) is 44% of the posterior layer B width ($w_B$).

Preferably, the posterior tab height ($h_B$) may be between 1 and 3 inches. In a particularly preferred embodiment the posterior tab height ($h_B$) is 2.25 inches. In another particularly preferred embodiment the posterior tab height ($h_B$) is 2.82 inches. The posterior tab height ($h_B$) may be the same or different for each posterior tab 13. In one embodiment, at least one posterior tab 13 has a height (first height) that differs from the height (second height) of another posterior tab 13. The anterior tab heights ($h_A$) and the posterior tab heights ($h_B$) may be the same or different. In one embodiment, the height of at least one posterior tab 13 differs from the height of at least one anterior tab 3.

Preferably, the number of posterior tabs 13 and the number of anterior tabs 3 is different. The number of posterior tabs 13 can be greater than the number of anterior tabs 3 or the number of anterior tabs 3 can be greater than the number of posterior tabs 13. Referring to FIG. 1, in a preferred embodiment there are five posterior tabs 13 and six anterior tabs 3. In another exemplary embodiment there are six posterior tabs 13 and five anterior tabs 3. In another exemplary embodiment there are four posterior tabs 13 and five anterior tabs 3. In another exemplary embodiment there are three posterior tabs 13 and four anterior tabs 3.

The posterior openings have breadths 141, 142. Preferably, at least one posterior opening 14 has a first posterior opening breadth 141 and at least another posterior opening 14 has a second posterior opening breadth 142. In a preferred embodiment, the horizontal sequence of posterior tab breadths 131 and posterior opening breadths 141 lacks a defined sequence.

In a preferred embodiment of shingle 10, both the horizontal sequence of anterior tab breadths 31 and anterior opening breadths 41 and the horizontal sequence of posterior tab breadths 131 and posterior opening breadths 141 lack a defined sequence. This creates a visually more intricate shingle and improves its aesthetic appearance.

In a preferred embodiment, the anterior tab breadths 31 and posterior tab breadths 131 are different. This prevents the posterior tabs 13 and anterior tabs 3 from becoming aligned by chance when installed on a roof deck, as illustrated in FIG. 7.

Preferably, the anterior layer A width ($w_A$) is greater than the posterior layer B width ($w_B$). In a preferred embodiment the anterior top portion 1 is wider than the posterior top portion 11 and the posterior top portion 11 is wider than the anterior bottom portion 2.

In a preferred embodiment, no part of the anterior layer A overlaps the posterior tabs 13. This is in contrast to prior art shingles that have more than one layer each having tabs discussed above. In those prior art shingles there is always at least some overlap between the other layers and the posterior tabs. See, e.g., U.S. Pat. No. 6,679,020. Preferably, in the present invention the anterior tabs 3 do not extend beyond the posterior top portion 11. In a particularly preferred embodiment, the anterior tabs 3 do not overlap the posterior tabs 13. In a particularly preferred embodiment, the front edges of the anterior tabs 3 are vertically aligned with the lower edge of the posterior top portion 11. In this configuration, even if the anterior layer A width ($w_A$) is greater than the posterior layer B width ($w_B$), the posterior tabs 13 are not covered by the anterior layer A. Not being limited to any particular theory, the vertical offset relationship between the anterior tabs 3 and the posterior tabs 13 creates the visual appearance of a small exposure shingle and an increased number of courses.

In one embodiment, the vertical offset of the anterior layer A relative to the posterior layer B is such that the front edges of the anterior tabs 3 extend beyond the lower edge of the posterior top portion 11. In another embodiment, the vertical offset of the anterior layer A relative to the posterior layer B is such that the anterior tabs 3 do not extend to the lower edge of the posterior top portion 11.

In a preferred embodiment, the composite headlap 101 comprises the anterior top portion 1 and at least part of the posterior top portion 11, in particular, that part of the posterior top portion 11 that is overlapped by the anterior top portion 1. The composite buttlap 102 comprises the posterior bottom portion 12, anterior bottom portion 2 and at least part of the posterior top portion 11, in particular that part of the posterior top portion 11 that is overlapped by the anterior bottom portion 2.

The horizontal sequence of anterior tabs 3 and anterior openings 4 in the anterior bottom portion 2 can be such that either an anterior tab 3 or an anterior opening 4 can be present at either end of the anterior layer A. Similarly, the horizontal sequence of posterior tabs 13 and posterior openings 14 in the posterior bottom portion 12 can be such that either a posterior tab 13 or a posterior opening 14 can be present at either end of the posterior layer B. In a preferred embodiment, the horizontal sequence of anterior tabs 3 and anterior openings 4 is such that the anterior bottom portion 2 has an anterior opening 4 at one end of the anterior layer A and an anterior tab 3 at the other end of the anterior layer A. In another preferred embodiment, the horizontal sequence of posterior tabs 13 and posterior openings 14 is such that the posterior bottom portion 12 has a posterior opening 14 at one end of the posterior layer B and a posterior tab 13 at the other end of the posterior layer B.

In a particularly preferred embodiment, the horizontal sequence of anterior tabs 3 and anterior openings 4 is such that the anterior bottom portion 2 has an anterior opening 4 at one end of the anterior layer A and an anterior tab 3 at the other end of the anterior layer A and the horizontal sequence of posterior tabs 13 and posterior openings 14 is such that the posterior bottom portion 12 has a posterior opening 14 at one end of the posterior layer B and a posterior tab 13 at the other end of the posterior layer B such that the end of the anterior layer A that has an anterior opening 4 is at the opposite end of the shingle 10 to the end of the posterior layer B having a posterior opening 14.

It should be understood that the particular horizontal alignment between the anterior tabs and the posterior tabs illustrated in FIG. 1 is only illustrative. In a preferred embodiment, the posterior tabs 13 and the posterior openings 14 have no specific alignment with respect to the anterior tabs 3 and the anterior openings 4. This means that the horizontal alignment of tabs may vary between shingles. In another preferred embodiment, a specific alignment of the anterior tabs 3 and the posterior tabs 13 is selected, resulting in a recurring pattern when the shingles are used in a roofing system as described below.

In one embodiment, the anterior tabs 3, the anterior openings 4, the posterior tabs 13 and the posterior openings 14 have right angle corners. Depending on the ratio of the tab height and tab breadth, the tabs can be rectangles or dragon teeth. In another embodiment the anterior tabs 3, the anterior openings 4, the posterior tabs 13 and the posterior openings 14 have curved edges.

FIG. 2 depicts a shingle 10*a* incorporating another embodiment of the invention in which the anterior tabs 3*a*, the anterior openings 4*a*, the posterior tabs 13*a* and the posterior openings 14*a* are trapezoids.

FIGS. 2A and 2B separately illustrate a top plan view of the anterior layer Aa and posterior layer Ba, respectively of the shingle shown in FIG. 2.

Referring to FIG. 2A, in one embodiment, the anterior tabs 3*a* are isosceles trapezoids wherein the breadth of the back edge of the anterior tab 3*a* is about 111% of the anterior tab breadth 31*a*. Preferably, the anterior tab breadths 31*a* are the same. In a particularly preferred embodiment the anterior tab breadth 31*a* is 9.34 inches.

Preferably, the central anterior openings 4*a* are isosceles trapezoids wherein the breadth of the back edge of the central anterior opening 4*a* is about 90% of the central anterior opening breadth 41*a*. In a particularly preferred embodiment the central anterior opening breadth 41*a* is 10.34 inches. Preferably the end anterior openings 4*b* are right-angle trapezoids wherein the right-angles abut the end of the anterior layer Aa wherein the breadth of the back edge of the end anterior opening 4*b* is about 90% of the end anterior opening breadth 42*b*. Preferably, the end anterior opening breadths 42*b* are the same. In a particularly preferred embodiment the end anterior opening breadth 42*b* is 5.17 inches. Preferably, the central anterior opening breadth 41*a* is twice the end anterior opening breadth 42*b*.

Referring to FIG. 2B, in a preferred embodiment, the central posterior tabs 13*a* are isosceles trapezoids wherein the breadth of the back edge of the central posterior tab 13*a* is about 111% of the central posterior tab breadth 131*a*. In a particularly preferred embodiment the central posterior tab breadth 131*a* is 9.34 inches. Preferably, the end posterior tabs 13*b* are right angle trapezoids wherein the right-angles abut the end of the posterior layer Ba wherein the breadth of the back edge of the end posterior tab 13*a* is about 111% of the end posterior tab breadth 132*b*. Preferably the end posterior tab breadths 132*b* are the same. In a particularly preferred embodiment the end posterior tab breadth 132*b* is 4.67 inches. Preferably, the central posterior tab breadth 131*a* is twice the end posterior tab breadth 132*b*.

Preferably, the posterior openings 14*a* are isosceles trapezoids wherein the breadth of the back edge of the posterior opening 14*a* is about 90% of the posterior opening breadth 141*a*. Preferably, the posterior opening breadths 141*a* are the same. In a particularly preferred embodiment the posterior opening breadth 141*a* is 10.34 inches.

Preferably, the anterior tab breadth 31*a* is the same as the central posterior tab breadth 131*a*. Preferably, the central anterior opening breadth 41*a* is the same as the posterior opening breadth 141*a*.

Referring to FIG. 2A, in a preferred embodiment, the anterior layer Aa has two anterior tabs 3*a*, one central anterior opening 4*a* and two end anterior openings 4*b*. The horizontal sequence of tabs and openings is such that the anterior bottom portion 2*a* has an opening at both ends of the anterior bottom portion 2*a* and at the center of the anterior bottom portion 2*a*.

Referring to FIG. 2B, in a preferred embodiment, the posterior layer Ba has one central posterior tab 13*a*, two end posterior tabs 13*b* and two posterior openings 14*a*. The horizontal sequence of tabs and openings is such that the posterior bottom portion 12*a* has a tab at both ends of the posterior bottom portion 12*a* and at the center of posterior bottom portion 12*a*.

Preferably, the anterior tab height ($h_A$) and the posterior tab height ($h_B$) are the same. In a particularly preferred embodiment, the anterior tab height is 2.82 inches and the posterior tab height is 2.82 inches.

Referring again to FIG. 2, preferably, the anterior tabs 3*a* are horizontally aligned with the posterior openings 14*a*. Preferably, the central anterior openings 4*a* are horizontally aligned with the central posterior tabs 13*a*. Preferably, the end anterior openings 4*b* are horizontally aligned with the end posterior tabs 13*b*. Not being limited to any particular theory, this arrangement makes the posterior tabs appear to be larger hexagonal tabs. In this preferred embodiment all shingles have the same horizontal sequence and alignment of tabs and openings.

Referring to FIGS. 1, 1A, 1B, 2, 2A, and 2B, the exposed top outer surface or weather surface of the invention may be coated with various types of mineral granules to protect the asphalt coating, to add color to shingles 10, 10*a* of the invention, and to provide fire resistance. A wide range of mineral colors from white and black to various shades of red, green, brown and any combination thereof may be used on shingles 10, 10*a* of the invention to provide a roof having the desired color. In some embodiments, the entire top outer surface of shingles 10, 10*a* of the invention may be coated with any of the aforementioned coatings. In further embodiments, the entire top surface of anterior layers A, Aa may be coated with coatings that contrast with coatings applied to the entire top surface of posterior layers B, Ba. The underside of shingles 10, 10*a* of the invention may be coated with various inert minerals with sufficient consistency to seal the asphalt coating. These modifications may be applied to any contemplated embodiment of the invention in any combination.

In some embodiments, the anterior tabs 3, 3*a* and the posterior tabs 13, 13*a* may be surfaced with mineral granules, which may be colored mineral granules. The colored mineral granules of the anterior tabs 3, 3*a* may be the same shade as the posterior tabs 13, 13*a* or may be different, i.e., the anterior tabs 3, 3*a* may have a first shade and the posterior tabs 13, 13*a* may have a second shade. The contrast in shade between the posterior tabs 13, 13*a* and the anterior tabs 3, 3*a* can be accentuated by varying the consistency of the weather resistant top coating, e.g., the density and/or size of granule deposition on either of these members. It should be noted that the shading of the colored mineral granules is not a necessary element of the present invention and therefore any shading scheme is appropriate.

In some embodiments, the anterior top portion 1 and the posterior top portion 11 may also be at least partially surfaced with mineral granules, which may be colored mineral granules. In a preferred embodiment at least the visible part of anterior top portion 1 has the same shade as the anterior tabs 3 and at least the visible portion of the posterior top portion 11 has the same shade as the posterior tabs 13.

In a preferred embodiment about 64% of the shingle is exposed and surfaced with mineral granules.

In some embodiments at least the visible portion of the shingles has at least two horizontal striations of a darker color to give the appearance of shadows. These striations may be broken up by tabs on the same shingle or by shingles in other courses. In other embodiments there are six striations per shingle, two dark striations, two spill striations and two light striations.

Figure 3:
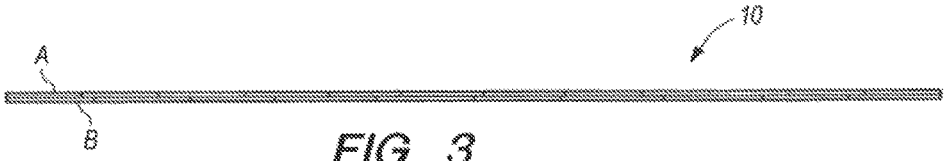
FIG. 3 shows a front elevation view of the exemplary embodiment of the roofing shingle of the present invention depicted in FIG. 1.
Figure 4:
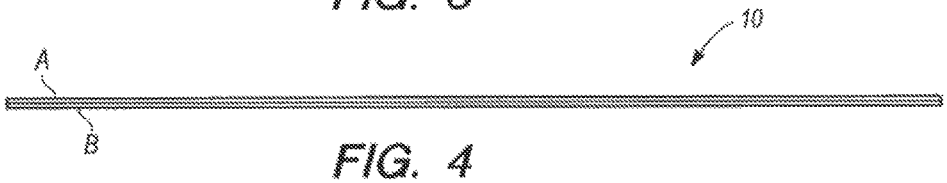
FIG. 4 shows a rear elevation view of an exemplary embodiment of the roofing shingle of the present invention.

FIGS. 3 and 4 illustrate front elevation and rear elevation views of shingle 10, respectively, with the anterior layer A positioned on the posterior layer B in a manner such that the left and right side edges of both layers are flush, respectively.

Figure 5:
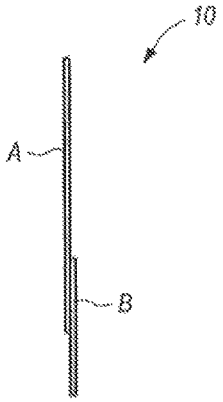
FIG. 5 shows a right side view of an exemplary embodiment of the roofing shingle of the present invention.
Figure 6:
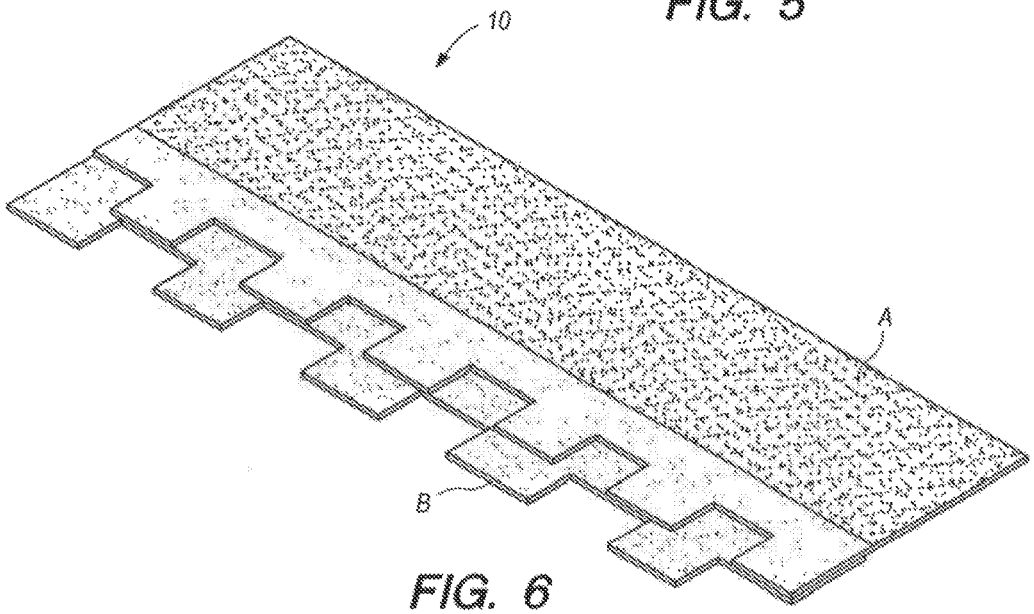
FIG. 6 shows a perspective view of the exemplary embodiment of the roofing shingle of the present invention depicted in FIG. 1.

FIG. 5 illustrates a right side view of shingle 10 with anterior layer A positioned on the posterior layer B in a manner such that the front and rear edges of both layers are vertically offset. Referring to FIGS. 1A and 1B, in a preferred embodiment, the width of the anterior layer A ($w_A$) is greater than the width of the posterior layer B ($w_B$). FIG. 5 illustrates that the inventive shingle 10 is composed of a single layer in some areas, such as the posterior tabs 13, and is composed of a double layer in other areas, such as where the anterior tabs 3 are affixed to the top portion of the posterior layer 11. This has the advantage of reducing the amount of shingle material needed to cover a given unit area whilst still maintaining adequate leak protection when the shingles are installed in a roofing system of overlapping courses as described below. A reduction in roofing material also translates into reduced weight and thus reduced shipping costs. In a particularly preferred embodiment, there is at least partial overlap between the top portion of the anterior layer 1 and the top portion of the posterior layer 11.

In a particularly preferred embodiment the width of the anterior layer A ($w_A$) is at least double the width of the posterior layer B ($w_B$). In addition to reducing the amount of roofing material necessary to make the laminated shingles, this also facilitates packing and storage of the laminated shingles since two shingles can be packed together in a space efficient manner by facing the two posterior surfaces in opposite directions.

FIG. 7 depicts a particularly preferred roofing system embodiment of the present invention, wherein shingles 10 of the invention are installed as they would be applied to a roof deck, such that a part of the composite headlap 101 of a previously installed course of shingles lies beneath a part of the composite buttlap 102 of a subsequently installed course of shingles. In a preferred embodiment, the subsequently installed shingles do not extend over the posterior tabs 13 of the previously installed course of shingles. Preferably, the posterior tabs 13 of the subsequently installed course of shingles do not extend beyond the anterior top portion 1 of the previously installed course of shingles. In a particularly preferred embodiment, the posterior tabs 13 of the subsequently installed course of shingles extend over the previously installed course of shingles such that the posterior tabs 13 are vertically aligned with the lower edge of the anterior top portion 1 but do not extend over the anterior tabs 3 of the previously installed course of shingles, creating the appearance that the posterior tabs 13 of the shingles in the subsequently installed course are laminated. The system of shingles thus reduces the use of roofing material needed to cover a given area by reducing the amount of overlap between shingles in different courses whilst still providing adequate leak protection and providing a pleasing aesthetic appearance.

In a preferred embodiment the shingles are installed in an offset manner with no predetermined system of positioning between the tabs of the shingles in different courses. This simplifies installation and creates an intricate, aesthetically appealing appearance that resembles more expensive roofing material, such as tile, slate, or wood shakes. The pattern of the anterior tabs 3 and the posterior tabs 13 provides a seemingly random appearance that provides the illusion of texture and variation inherent in individual pieces of more expensive roofing materials. The visual appearance of the shingles may be further enhanced by methods well-known in the art, e.g., employing striations, shadow tips or shadow bands.

In a further preferred embodiment utilizing preferred shingles as described above in which the horizontal sequence of anterior tabs 3 and anterior openings 4 is such that the anterior bottom portion 2 has an anterior opening 4 at one end of the anterior layer A and an anterior tab 3 at the other end of the anterior layer A and the horizontal sequence of posterior tabs 13 and posterior openings 14 is such that the posterior bottom portion 12 has a posterior opening 14 at one end of the posterior layer B and a posterior tab 13 at the other end of the posterior layer B; such that the end of the anterior layer A that has an anterior opening 4 is at the opposite end of the shingle 10 to the end of the posterior layer B having a posterior opening 14; the shingles in each course are arranged such that the end of each shingle at which a posterior tab 13 is located horizontally abuts the end of a shingle having a posterior opening 14 at the abutting end. This results in a horizontal arrangement of shingles such that where two shingles horizontally abut in a course, a tab in one shingle is always abutted against an opening in the next shingle in both the anterior and posterior layers, see FIG. 7.

Not being limited to any particular theory, the aesthetically pleasing appearance of a particularly preferred embodiment of the installed shingles of the invention may result from the offset relationship (both horizontally and vertically) of the posterior tabs 13 and anterior tabs 3 of each shingle. This may create an appearance that the number of courses is greater than the number actually present or that the exposure per shingle is less than is actually present. This creates a visual illusion of thicker, more expensive shingles since the only point of reference for the eye is the apparent width of the courses. Prior art small exposure shingles also attempt to create this effect, but are more expensive to manufacture because they require more roofing material per unit area and are more expensive to install since the number of shingles to be affixed per unit area is greater. The appearance of randomness and intricacy is further enhanced in the preferred embodiment in which there is no requirement for a specific horizontal sequence of anterior tab breadths 31 and anterior opening breadths 41 nor a specific horizontal sequence of posterior tab breadths 131 and posterior opening breadths 141 in each shingle.

Figure 8:
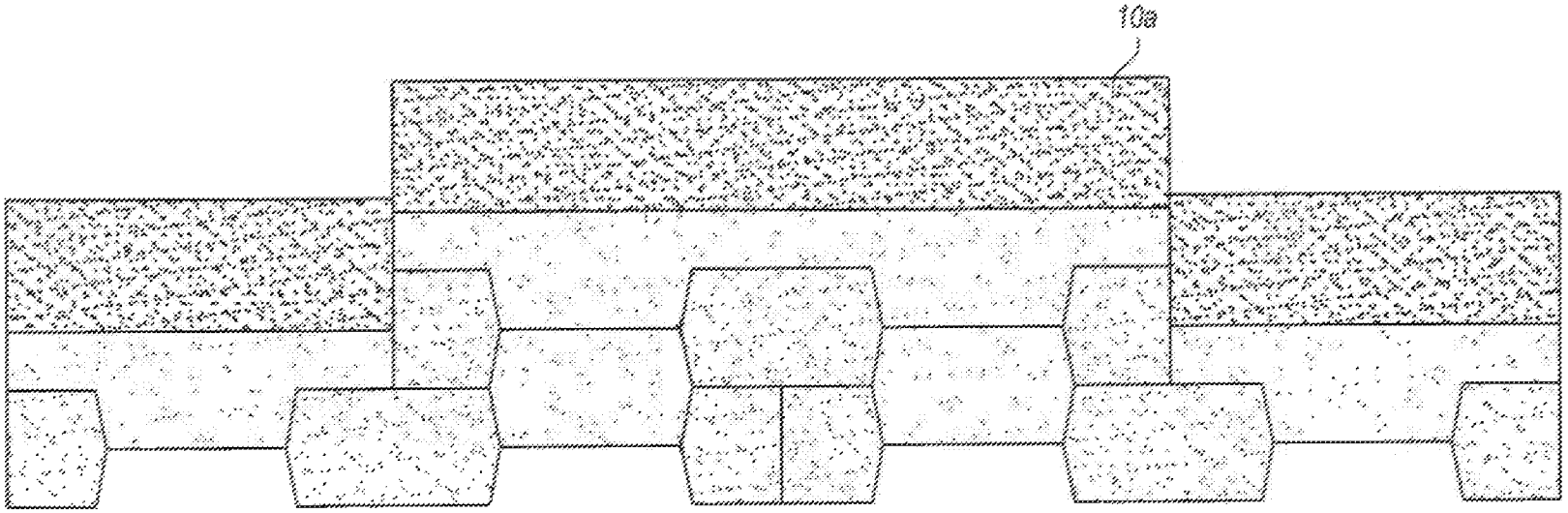
FIG. 8 shows a top plan view of an exemplary embodiment of a roofing system of the present invention incorporating a two-layer roofing shingle embodiment of the present invention depicted in FIG. 2.

FIG. 8 depicts another preferred roofing system embodiment of the present invention in which singles as illustrated in FIG. 2 are installed in a horizontally offset manner such that the anterior tabs 3*a* of shingles in the subsequently installed course are horizontally aligned with the anterior tabs 3*a* of shingles in the previously installed course and the center posterior tabs 13*a* of shingles in a subsequently installed course are horizontally aligned with the end posterior tabs 13*b* in a previously installed course such that the seam between two end posterior tabs 13*b* in the previously installed course is aligned with the horizontal center of the center posterior tab 13*a* of the subsequently installed course. Hence the posterior tabs 13*a* of the subsequently installed course of shingles at least partially cover the seams between the shingles of the previously installed course. This has the advantage of providing enhanced leak protection and reducing the amount of roofing material needed to cover a given area. The roofing system also creates an attractive repeating hexagonal pattern formed by the interlocking trapezoid tabs of adjacent shingles.

An exemplary non-limiting method of manufacturing the inventive shingle embodiments is described with reference to the two-layer composite shingle 10.

Manufacturing the two-layer composite shingle 10 includes applying granules to asphalt coated sheeting, where the granules can be blended to produce the desired shading and then applied to the surface of the asphalt sheet. The granule laden asphalt sheet is then pressed in a press roll unit, such that the granules embed in the asphalt coating. The asphalt sheet is then cut to the desired shape.

Preferably, multiple anterior layers A and posterior layers B are cut from a single sheet on a 2-wide machine line, a 4-wide machine line or a 6-wide machine line.

In a particularly preferred embodiment four anterior layers A and four posterior layers B are cut from a single sheet on a 4-wide machine line, as illustrated in FIGS. 9A and 9B. The anterior layers A form two complementary pairs and the posterior layers B form two complementary pairs. The two cuts necessary to form the tabs of the anterior layers A may be performed in the outer lanes of the machine line and the two cuts necessary to form the tabs of the posterior layers B may be performed in the inner lanes, as illustrated in FIG. 9A. Alternatively, the two cuts necessary to form the tabs of the anterior layers A may be performed in the inner lanes of the machine line and the two cuts necessary to form the tabs of the posterior layers B may be performed in the outer lanes, as illustrated in FIG. 9B. The straight back edges of the layers are then cut as necessary to provide the individual anterior layers A and posterior layers B.

Following cutting, the posterior layer B and anterior layer A are joined. In broad terms, preferably, an adhesive is applied to the posterior layer B and/or anterior layer A, wherein following the application of the adhesive the posterior layer B and anterior layer A are pressed together.

Preferably, the present invention also allows for a reduction in material waste during manufacturing. The present invention minimizes scrap material by utilizing the entire (or nearly the entire) amount of a single sheet of roofing material apportioned for the formation of the anterior layers A and the posterior layers B. By cutting complementary anterior layers A and posterior layers B from a single sheet of roofing material, the process minimizes scraps.

In a preferred embodiment, there is no requirement for a specific sequence of anterior tab breadths 31 and anterior tab openings 41. This means that an anterior layer A can be cut that has a sequence of varying anterior tab breadths 31 and anterior tab openings 41 without generating any scraps in the formation of the complementary anterior layer A. In another preferred embodiment, there is no requirement for a specific sequence of posterior tab breadths 131 and posterior tab openings 141. This means that a posterior layer B can be cut that has a sequence of varying posterior tab breadths 131 and posterior tab openings 141 without generating any scraps in the formation of the complementary posterior layer B. This allows for the use of the entire sheet of roofing material to form complementary anterior layers A and complementary layers B as illustrated in FIGS. 9A and 9B.

In a preferred embodiment, the horizontal sequence of anterior tabs 3 and anterior openings 4 is such that the anterior bottom portion 2 has an anterior opening 4 at one end of the anterior layer A and an anterior tab 3 at the other end of the anterior layer A and the horizontal sequence of posterior tabs 13 and posterior openings 14 is such that the posterior bottom portion 12 has a posterior opening 14 at one end of the posterior layer B and a posterior tab 13 at the other end of the posterior layer B. This enables anterior layers A to be cut from the same sheet each having the same number of tabs and openings as the complementary anterior layers A and posterior layers B to be cut from the same sheet each having the same number of tabs and openings as the complementary posterior layers B, without the generation of scraps.

In a preferred embodiment, the width of the sheet is 56.5 inches. In another preferred embodiment the width of the sheet is 67.75 inches.

As depicted in FIG. 10, two-layer composite shingle 10*a* may also be cut on a 4-wide machine line using analogous methods with the anterior layers Aa and posterior layers Ba forming respective complementary pairs.

For one embodiment of the present invention, the shingle 10 may be formed from a fiberglass mat (not shown) with an asphalt coating on both sides of the mat. If desired, the present invention may also include shingles formed from organic felt or other types of base material, including but not limited to synthetic mats or synthetic glass/hybrid mats having an appropriate coating. Nonlimiting embodiments of coatings include asphalt and modified bituminous coatings based on atactic polypropylene (APP), styrene-butadiene-styrene (SBS), styrene-ethylene-butadiene-styrene (SEBS), amorphous polyalpha olefin (APAO), thermoplastic polyolefin (TPO), synthetic rubber or other asphaltic modifiers.

Although the present invention and its advantages have been described in detail, it should be understood that various changes, substitutions and alterations can be made therein without departing from the spirit and scope of the invention as defined by the appended claims.

What is claimed is:

1. A two-layer laminated roofing shingle comprising:

(a) a posterior layer having a posterior top portion having a posterior upper edge and a posterior lower edge, and a posterior bottom portion including a plurality of posterior tabs extending from said posterior top portion along said posterior lower edge, said posterior tabs spaced apart to define a plurality of posterior openings between said posterior tabs;

(b) an anterior layer having an anterior top portion having an anterior upper edge and an anterior lower edge, and an anterior bottom portion including a plurality of anterior tabs extending from said anterior top portion along said anterior lower edge, said anterior tabs spaced apart to define a plurality of anterior openings between said anterior tabs;

wherein the anterior layer is wider than the posterior layer;

wherein the anterior layer is positioned such that it partially overlaps the posterior layer such that the anterior tabs are positioned over the top portion of the posterior layer; wherein the shingle has only two layers; and wherein front edges of the anterior tabs are vertically aligned with said posterior lower edge.

2. The roofing shingle according to claim 1, wherein there is at least partial overlap between the top portion of the anterior layer and the top portion of the posterior layer.

3. The roofing shingle according to claim 1, wherein the anterior layer and the posterior layer have the same length.

4. The roofing shingle according to claim 1, wherein the number of posterior tabs and the number of anterior tabs is different.

5. The roofing shingle according to claim 1, comprising five posterior tabs and six anterior tabs.

6. The roofing shingle according to claim 1, comprising three posterior tabs and two anterior tabs.

7. The roofing shingle according to claim 1, wherein the posterior tabs and the anterior tabs are horizontally offset.

8. The roofing shingle according to claim 1, wherein the anterior tabs and the posterior openings are horizontally aligned.

9. The roofing shingle according to claim 1, wherein the posterior tabs and posterior openings have no specific horizontal alignment with respect to the anterior tabs and anterior openings.

10. The roofing shingle according to claim 1, wherein at least one anterior tab has a first anterior tab breadth and at least another anterior tab has a second anterior tab breadth that differs from the first anterior tab breadth.

11. The roofing shingle according to claim 1, wherein at least one anterior tab has a first anterior tab height and at least another anterior tab has a second anterior tab height that differs from the first anterior tab height.

12. The roofing shingle according to claim 1, wherein at least one anterior opening has a first anterior opening breadth and at least another anterior opening has a second anterior opening breadth that differs from the first anterior opening breadth.

13. The roofing shingle according to claim 1, wherein at least one posterior tab has a first posterior tab breadth and at least another posterior tab has a second posterior tab breadth that differs from the first posterior tab breadth.

14. The roofing shingle according to claim 1, wherein at least one posterior tab has a first posterior tab height and at least another posterior tab has a second posterior tab height that differs from the first posterior tab height.

15. The roofing shingle according to claim 1, wherein at least one posterior opening has a first posterior opening breadth and at least another posterior opening has a second posterior opening breadth that differs from the first posterior opening breadth.

16. The roofing shingle according to claim 1, wherein both the posterior layer and the anterior layer have a tab at one end of the shingle and an opening at the other end of the shingle such that the end opening of the anterior layer is at the opposite end of the shingle to the end opening of the posterior layer.

17. The roofing shingle according to claim 1, wherein the posterior tab breadths and the anterior tab breadths are the same.

18. The roofing shingle according to claim 1, wherein the posterior tab breadths and the anterior tab breadths are different.

19. The roofing shingle according to claim 1, wherein the posterior tab heights and the anterior tab heights are the same.

20. The roofing shingle according to claim 1, wherein the height of at least one posterior tab differs from the height of at least one anterior tab.

21. The roofing shingle according to claim 1, wherein the posterior tab height is between about 40% and 50% of the posterior layer width.

22. The roofing shingle according to claim 1, wherein the anterior tab height is between about 15% and 30% of the anterior layer width.

23. The roofing shingle according to claim 1, wherein the posterior tab height is about 2.25 inches and the anterior tab height is about 2.25 inches.

24. The roofing shingle according to claim 1, wherein each anterior tab, each anterior opening, each posterior tab and each posterior opening has right angle corners.

25. The roofing shingle according to claim 1, wherein each anterior tab, each anterior opening, each posterior tab and each posterior opening is a trapezoid.

26. The roofing shingle according to claim 1, wherein the length of the shingle is about 39.375 inches.

27. The roofing shingle according to claim 1, wherein the width of the shingle is about 13.25 inches.

28. The roofing shingle according to claim 1, wherein the width of the posterior layer is between about 30% and 70% of the width of the anterior layer.

29. The roofing shingle according to claim 1, wherein the width of the posterior layer is about 5.375 inches.

30. The roofing shingle according to claim 1, wherein the width of the anterior layer is about 11 inches.

31. The roofing shingle according to claim 1, wherein the posterior tabs and the anterior tabs are the same color.

32. The roofing shingle according to claim 1, wherein the posterior tabs and the anterior tabs are different colors.

33. The roofing shingle according to claim 1, wherein the anterior tabs are the same color as at least part of the anterior top portion.

34. The roofing shingle according to claim 1, wherein the posterior tabs are the same color as at least part of the posterior top portion.

35. The roofing shingle according to claim 1, wherein the length of the shingle is about 39.375 inches, wherein the width of the shingle is about 13.25 inches, wherein the posterior tab height is about 2.82 inches, wherein the anterior tab height is about 2.82 inches, wherein the width of the posterior layer is about 6.5 inches and, wherein the width of the anterior layer is about 10.44 inches.

36. A roofing system comprising at least two, two-layer laminated roofing shingles in vertically adjacent courses, each of the shingles comprising:

(a) a posterior layer having a posterior top portion having a posterior upper edge and a posterior lower edge, and a posterior bottom portion including a plurality of posterior tabs extending from said posterior top portion along said posterior lower edge, said posterior tabs spaced apart to define a plurality of posterior openings between said posterior tabs; and (b) an anterior layer having an anterior top portion having an anterior upper edge and an anterior lower edge, and an anterior bottom portion including a plurality of anterior tabs extending from said anterior top portion along said anterior lower edge, said anterior tabs spaced apart to define a plurality of anterior openings between said anterior tabs;

wherein the anterior layer is wider than the posterior layer;

wherein the anterior layer is positioned such that it partially overlaps the posterior layer such that the anterior tabs are positioned over the top portion of the posterior layer, wherein the shingle in the upper course is positioned to partially overlap the shingle in the lower course such that the posterior tabs of the shingle in the upper course partially overlap the anterior top portion of the shingle in the lower course;

wherein the shingle has only two layers; and wherein front edges of the anterior tabs are vertically aligned with said posterior lower edge.

37. The roofing system according to claim 36, wherein front edges of the posterior tabs of the shingle in the upper course are vertically aligned with said anterior lower edge of the shingle in the lower course.

38. The roofing system according to claim 36, wherein the posterior tabs of the shingle in the upper course partially overlap the anterior tabs of the shingle in the lower course.

39. The roofing system according to claim 36, wherein the posterior tabs of the shingle in the upper course extend to front edges of the anterior tabs of the shingle in the lower course.

40. The roofing system according to claim 36, wherein shingles in vertically adjacent courses are horizontally offset.

41. The roofing system according to claim 36, wherein the tabs of each shingle have a random horizontal offset relationship relative to the tabs of shingles in other courses.

42. The roofing system according to claim 36, wherein the shingles are horizontally offset and the anterior tabs are horizontally aligned.

43. The roofing system according to claim 36, wherein the shingles in each course are arranged such that if a first shingle has a posterior tab at an end, it horizontally abuts a second shingle such that said posterior tab abuts a posterior opening at an end of the second shingle.

44. The roofing system according to claim 36, wherein the shingles in each course are arranged such that if a first shingle has an anterior tab at an end, it horizontally abuts a second shingle such that said anterior tab abuts an anterior opening at an end of the second shingle.

45. The roofing system according to claim 36, wherein there are 9 tabs per square foot.

46. A roofing system comprising a plurality of courses of shingles according to claim 36, wherein the shingles are installed on a roof deck in overlapping courses.

47. The roofing system according to claim 36, wherein the seams between shingles in the lower course are covered by posterior tabs of shingles in the upper course.

48. The roofing system according to claim 36, wherein the roofing system gives the visual appearance of a number of courses that is greater than the actual number of courses.

49. A method of manufacturing a two-layer laminated roofing shingle, the roofing shingle comprising:

(a) a posterior layer having a posterior top portion having a posterior upper edge and a posterior lower edge, and a posterior bottom portion including a plurality of posterior tabs extending from said posterior top portion along said posterior lower edge, said posterior tabs spaced apart to define a plurality of posterior openings between said posterior tabs; and (b) an anterior layer having an anterior top portion having an anterior upper edge and an anterior lower edge, and an anterior bottom portion including a plurality of anterior tabs extending from said anterior top portion along said anterior lower edge, said anterior tabs spaced apart to define a plurality of anterior openings between said anterior tabs;

wherein the anterior layer is wider than the posterior layer; wherein the anterior layer is positioned such that it partially overlaps the posterior layer such that the anterior tabs are positioned over the top portion of the posterior layer, wherein at least one anterior layer and at least one posterior layer are cut from a single sheet of roofing material;

wherein the shingle has only two layers; and wherein front edges of the anterior tabs are vertically aligned with said posterior lower edge.

50. The method of claim 49, wherein the sheet has a width of about 56.5 inches.

51. The method of claim 49, wherein the sheet has a width of about 67.75 inches.

52. The method of claim 49, wherein four of the posterior layers and four of the anterior layers are cut from a single sheet of roofing material.

53. The method of claim 49, wherein the tabs and the openings of at least two of the anterior layers are complementary.

54. The method of claim 49, wherein the tabs and the openings of at least two of the posterior layers are complementary.

55. The method of claim 49, wherein the anterior layers and the posterior layers each have an opening at one end of each layer and a tab at the other end of each layer.

56. The method of claim 49, wherein the layers are cut on a machine line selected from the group consisting of a 2-wide machine line, a 4-wide machine line and a 6-wide machine line.

57. The method of claim 56, wherein the anterior layers are cut on at least one outer lane.

58. The method of claim 56, wherein the posterior layers are cut on at least one outer lane.

59. The method of claim 49, wherein, the length of the shingle is about 39.375 inches, wherein the width of the shingle is about 13.25 inches, wherein the posterior tab height is about 2.25 inches, wherein the anterior tab height is about 2.25 inches, wherein the width of the posterior layer is about 5.375 inches and, wherein the width of the anterior layer is about 11 inches.

60. The method of claim 49, wherein, the length of the shingle is about 39.375 inches, wherein the width of the shingle is about 13.25 inches, wherein the posterior tab height is about 2.82 inches, wherein the anterior tab height is about 2.82 inches, wherein the width of the posterior layer is about 6.5 inches and, wherein the width of the anterior layer is about 10.44 inches.

* * * * *